United States Patent [19]

Miyakawa et al.

[11] 4,251,152

[45] Feb. 17, 1981

[54] ELECTROSTATIC APPARATUS FOR MULTI-IMAGE FORMATION

[75] Inventors: Seiichi Miyakawa, Nagareyama; Takashi Yano, Tokyo, both of Japan

[73] Assignee: Ricoh Company, Ltd., Japan

[21] Appl. No.: 948,742

[22] Filed: Oct. 5, 1978

[30] Foreign Application Priority Data

Oct. 7, 1977 [JP] Japan ..... 52-120633

[51] Int. Cl.[3] ..... G03G 15/00

[52] U.S. Cl. ..... 355/3 R; 355/3 CH; 346/153.1

[58] Field of Search ..... 355/3 R, 3 CH, 3 SC, 355/7; 430/54; 346/153, 155

[56] References Cited

U.S. PATENT DOCUMENTS

| | | | |
|---|---|---|---|
| 3,045,587 | 7/1962 | Schwertz | 355/3 R X |
| 3,045,644 | 7/1962 | Schwertz | 355/4 X |
| 3,329,769 | 7/1967 | Hell | 346/153 X |
| 3,793,986 | 2/1974 | Latone | 355/15 X |
| 3,976,484 | 8/1976 | Ando et al. | 355/3 R X |
| 3,977,778 | 8/1976 | Seko et al. | 355/3 R |
| 4,124,286 | 11/1978 | Barasch | 355/3 R |

*Primary Examiner*—Fred L. Braun

*Attorney, Agent, or Firm*—McGlew and Tuttle

[57] ABSTRACT

An apparatus for multi-image formation for use in electrophotography and electrostatic recording to permit the formation of two or more different latent electrostatic images on a dielectric or photoconductive material from different sources and synthesis of each of the different latent electrostatic images with an identical or a different polarity and potential.

6 Claims, 7 Drawing Figures

ELECTROSTATIC APPARATUS FOR MULTI-IMAGE FORMATION

BACKGROUND OF THE INVENTION

The present invention relates to a method and apparatus for multi-image formation in electrophotography and electrostatic recording process.

Electrophotography and electrostatic recording method were developed in order to reproduce information faithfully and speedily. Thereafter, the efforts of improving electrophotography and electrostatic recording method have been directed at making a clearer copy than the original document and reproducing the original at a high speed by copying selectively a necessary portion out of the original document. Making a clearer copy than the original or reproducing only a necessary portion of the original differs from the original object of electrophotography and electrostatic recording method for reproducing the original as faithfully as possible. Such a difference comes from the efforts of making the reproduced information more valuable. In other words, the efforts of making the reproduced information more valuable give rise to such a difference in the object of electrophotography and electrostatic recording method.

Reproducing a more valuable information signifies reproduction of a new information and a creation of information.

If a copying apparatus could make not only reproduction of an original, but also a creation of new information, that would be epoch-making. A new original can be prepared by clipping the original and by use of the conventional copying apparatus. However, this is not a creation of new information by the copying apparatus, but a manual creation of the original. A creation of information by copying apparatus signifies eliminating an unnecessary information from the original or adding new information to the original during the image formation process of copying apparatus.

The creation of information by copying apparatus can be attained by synthesizing images. In synthesizing images, it would be expedient to synthesize images at the step of a latent electrostatic image formation rather than synthesizing visible images. In the conventionally known synthesis of latent electrostatic images, on a first latent electrostatic image formed on a photoconductor by projecting a light images upon the photoconductor is superimposed a second latent electrostatic image which is formed from a light image or by a laser beam.

In the case where the first latent electrostatic image is a positive image, namely when the potential of an image area is higher than that of background, a second latent electrostatic image cannot be formed in the background area since the background does not have a sufficient potential.

On the other hand, if it is tried to form a second latent electrostatic image on the image area having a sufficient potential for forming a latent image, the image of the first latent electrostatic image will be destroyed and the second latent electrostatic image will not be formed accurately. Therefore, in the conventional method, the first latent electrostatic images is formed as a negative image in which the potential of an image area is low and the potential of background is high, and a negative second latent electrostatic image is formed on the background, so that a positive visible image is obtained by a reversed development method.

However, ordinary original documents mostly have positive images and it takes a special apparatus to form negative latent electrostatic images from the positive images. Therefore, an image overlapping process tends to become complicated.

SUMMARY OF THE INVENTION

It is therefore a primary object of the present invention to provide an improved method and apparatus for multi-image formation in electrophotography and electrostatic recording method.

Another object of the present invention is to provide the method and apparatus for multi-image formation capable of making each latent electrostatic image in the form of a positive image.

A further object of the present invention is to provide the method and apparatus for multi-image formation capable of multi-color development.

A further object of the present invention is to provide the method and apparatus for multi-image formation capable of erasing and addition of information as desired.

A still further object of the present invention is to provide the method and apparatus for multi-image formation which can be used in combination with a computer system.

In a multi-image formation process according to the present invention, of two or more latent electrostatic image formation processes, the first latent electrostatic image is formed by projecting a light image upon a photoconductor and the second latent and subsequent electrostatic image formations are formed by direct charging.

In another multi-image formation process according to the present invention, all of the latent electrostatic image formation processes are carried out by direct charging.

According to the present invention, each latent electrostatic image can be made in the form of a positive image. Therefore, the image formation process is simpler than the process of making negative images and has a wide application. Furthermore, when a second latent electrostatic image is superimposed on a first latent electrostatic image, the polarity and the potential level of the first latent electrostatic image do not affect the formation of the second latent electrostatic image, so that by changing the polarity and the potential level of each latent electrostatic image, multi-color development can be attained. Furthermore, according to the present invention, since two or more latent electrostatic images can be overlapped, not only a simple addition of information but also elimination of unnecessary information and addition of necessary information can be made at the same time.

In the present invention, various combinations of image formation methods can be made in synthesizing various image information. Furthermore, as the latent electrostatic image formation method employing an exposure means, Carlson method and NP process can be employed. As to latent electrostatic image formation by direct charging, Varian process can also be employed.

Furthermore, in synthesizing images, images can be synthesized not only side by side, namely horizontally, but also overlappingly, namely, vertically.

BRIEF DESCRIPTION OF THE DRAWINGS

For a better understanding of the invention as well as other objects and further features thereof, reference is had to the following detailed description of the invention to be read in connection with the accompanying drawings, wherein.

DETAILED DESCRIPTION OF THE PREFERRED EMBODIMENTS

Figure 1:
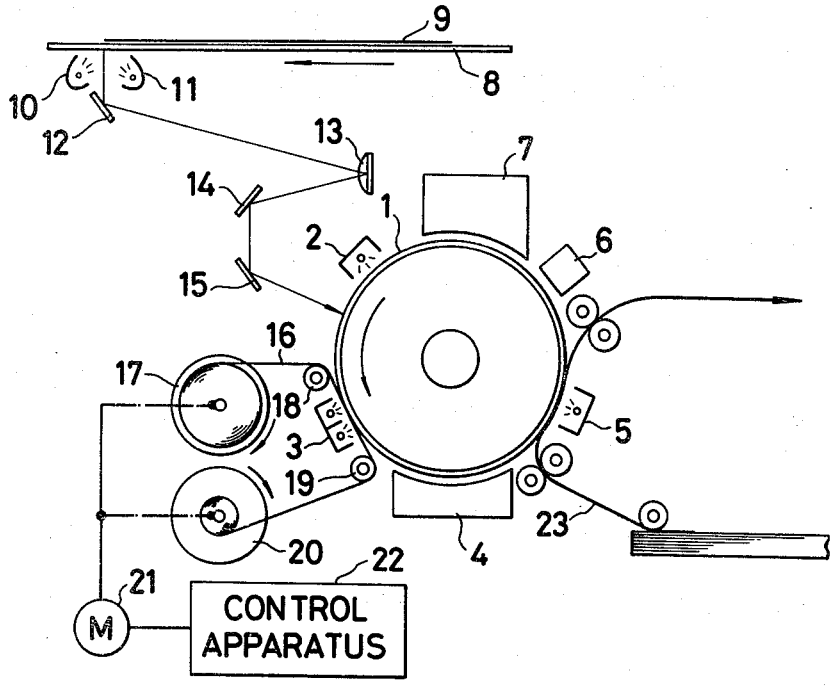
FIG. 1 is a schematic sectional side view of an electrophotographic copying apparatus employing multi-image formation method according to the present invention.

Referring to FIG. 1, there is shown schematically an example of an electrophotographic copying machine employing a multi-image formation method according to the present invention, wherein a first latent electrostatic image is formed by illumination on a photoconductor and also a second latent electrostatic image is then formed on the photoconductor by direct charging.

In FIG. 1, a photoconductive drum 1 having a photoconductive insulating layer thereon is rotated counterclockwise at a predetermined speed. Around the photoconductive drum 1, there are arranged a first corona charger 2, a second corona charger 3, a development apparatus 4, an image transfer corona charger 5, a quenching apparatus 6 and a cleaning apparatus 7.

In an upper portion of this electrophotographic copying machine, there is disposed horizontally a contact glass 8. An original 9 having a positive image is placed face-down on the contact glass 8. The contact glass 8 is horizontally movable. Under the contact glass 8, there are disposed illumination lamps 10 and 11, and a reflector 12.

Furthermore, under the contact glass 8, there are disposed an in-mirror lens 13 and reflectors 14 and 15 in a predetermined optical relationship with the illumination lamps 10 and 11 and the reflector 12. By this optical system, a light image of the original 9 is projected upon the surface of the photoconductor drum 1 which has been charged uniformly by the first corona charger 2. The first corona charger 2 is connected to a high voltage direct current power source. The polarity of the high voltage direct current power source to be connected to the first corona charger 2 depends upon the physical properties of the photoconductive surface layer of the photoconductor drum 1. For instance, in the case where the photoconductive surface layer is made of a selenium-base photoconductor, the surface layer is connected to a positive polarity side of the direct current power source. When a light image of the original 9 is projected upon the surface of the charged photoconductor drum 1, an area on the photoconductor surface corresponding to a light area of the original becomes electrically conductive so that the surface electric charge so far retained in the area of the photoconductor surface is conducted away. On the other hand, in an area on the photoconductor surface corresponding to a dark area of the original 9, the surface charge is retained. Thus, a first latent electrostatic image corresponding to the positive image of the original 9 is formed on the surface of the photoconductive drum 1.

Succeedingly, a second latent electrostatic image is formed on the photoconductive drum 1 in addition to the first latent electrostatic image, by direct charging made by the second corona charger 3. The principle of the formation of the latent electrostatic image by the second corona charger 3 without light illumination is very simple. Namely, on a dielectrics substrate is superimposed a dielectrics film in which letters, images or the like are perforated.

When electric charges are applied to the superimposed dielectrics film by a corona charger, corona ion passes only through the perforated portions so that latent electrostatic images of the letters or the images, which are in the same shapes as those of the perforated portions of the dielectrics film, are additionally formed on the dielectrics substrate.

Figure 2:
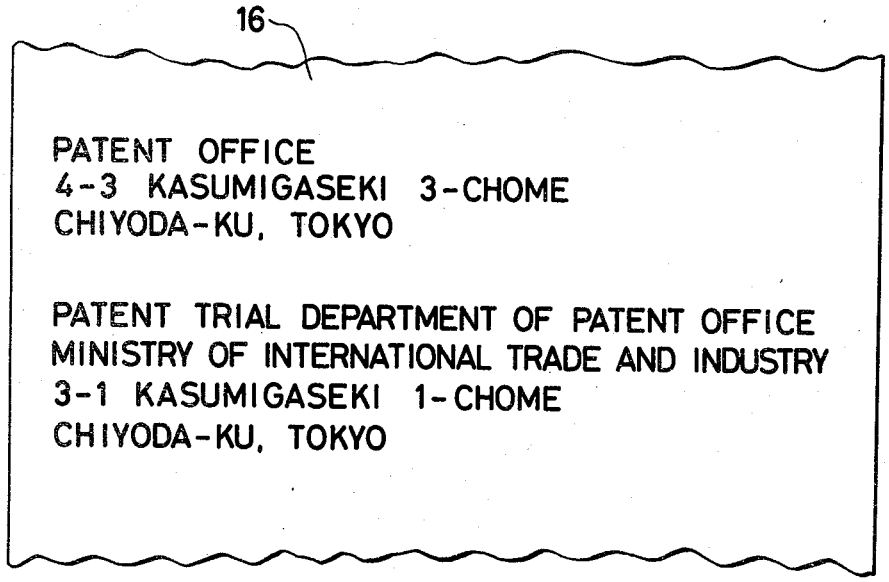
FIGS. 2 to 4 illustrate respectively a perforated film to be employed in the apparatus shown in FIG. 1.

For instance, a dielectrics film 16 in which a number of addresses are perforated as shown in FIG. 2 is fed between the surface of the photoconductive drum 1 and the second corona charger 3 from a film feeding reel 17 through guide rollers 18 and 19, and the film is wound on to a taking-up reel 20. Feeding and taking-up of the film 16 are made by a motor 21 and are controlled so as to be timed with the formation of the first latent electrostatic image by a control apparatus 22.

As a matter of course, the front surface of the film 16 faces the surface of the photoconductor drum 1, while the back surface of the film 16 faces the second corona charger 3. For instance, the original 9 is used for forming a first latent electrostatic image of the body of a letter. After the first latent electrostatic image has been formed, a second latent electrostatic image of an address of the letter is formed at the head of the letter by the second corona charger 3.

The thus formed latent images are developed by the development apparatus 4. The developed images are transferred to a transfer sheet 23 by the image transfer corona charger 5. Thus, with a single process of development and image transfer, a copy of a letter with an address at the head thereof is made. The surface of the photoconductor drum 1 is quenched by the quenching apparatus 6 and is then cleaned by the cleaning apparatus 7. After this, the same first latent electrostatic image is again formed on the surface of the photoconductor drum 1, and on the surface of the photoconductor drum 1 is formed another second latent electrostatic image of an address which is different from the previous address. Thus, a number of letters with the same body and different address are prepared continuously.

In case the contents of information to be copied are simple, such information can be recorded by forming dots or lines in the dielectrics film. According to the experiments conducted by the inventors of the present invention, when a 100 $\mu$m diameter perforation and a 300 $\mu$m wide and 5 mm long slit line were formed on a Mylar (trade name, commercially available from E. I. du Pont de Nemours & Co., Inc.) with the thickness in the range of 12 $\mu$m to 100 $\mu$m, and in accordance with the above-mentioned procedure, latent electrostatic images, whose surface potential was set in the range of 300 to 400 V, were formed on a photoconductor and developed. As a result, clear images were obtained.

Figure 3:
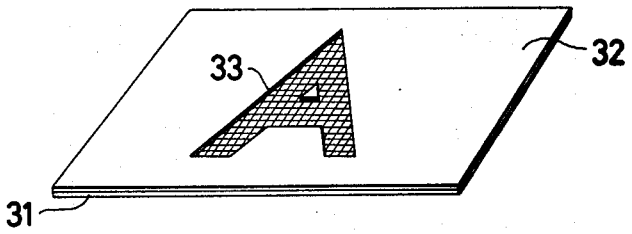

In the case where the contents of information to be formed in the dielectrics film are complicated, it is necessary to prepare a perforated film efficiently. Referring to FIG. 3, there is shown a principle of a new technique for speedy perforation of a dielectrics film. Reference numeral 31 represents a polyester film with small holes or meshes. A thermal shrinking plastic film 32 is applied to the polyester film 31. The electric resistivity of the thermal shrinking plastic film 32 can be lowered by adding carbon thereto. Also, the electric resistivity of the surface of the thermal shrinking plastic film 32 can be varied by a surface treatment of making the surface electrically conductive or semi-conductive. An image 33 is formed on the surface of the thermal shrinking plastic film 32 by a laser apparatus or by a thermal printing apparatus. The image portion of the thermal shrinking plastic film 32 is perforated by a laser beam or by shrinkage of the plastic film 32 due to the thermal printing, so that the meshes under the perforated portion of the thermal shrinking plastic film 32 are exposed.

In another technique, an aluminium foil is employed instead of the thermal shrinking plastic film 32. The aluminium foil is likewise applied to the mesh polyester film 31, and with a mask on the surface of the aluminium foil, an image is formed on the aluminium foil by etching. The etching liquid for this technique is a liquid which does not dissolve the mesh polyester film, but dissolves aluminium.

The conductive treatment of the thermal shrinking film 32 has the following meaning. No problem occurs to a latent electrostatic image formed through the perforated film so long as the electric potential of the latent electrostatic image is not more than approximately 400 V even when the perforated film is wholly dielectric. However, in the case where the electric potential of the latent electrostatic image is more than approximately 500 V, a spark discharge occurs when the perforated film is separated from the photoconductive drum 1. The spark discharge disturbs the first latent image. Therefore, when a high potential latent electrostatic image is formed, an electrically conductive perforated film is applied to an electrically insulating mesh film in order to prevent such spark discharge which may occur when the perforated film is separated from the photoconductive drum 1. In this case, the insulating mesh film is positioned so as to face the surface of the photoconductive drum 1.

When +6 kV of potential is applied to the conductive perforated film by a corona charger, with the conductive perforated film electrically floated, the surface charge of the conductive film becomes 700 to 1000 V and on the photoconductive drum 1, there is formed a latent electrostatic image of 500 V.

In the case where this conductive film is grounded, a latent electrostatic image of 400 V is formed on the photoconductive drum 1 under the same condition as mentioned above. When the potential of the latent electrostatic image is approximately 400 V, no leakage of charges occurs from the conductive film even if it is grounded. When the conductive film is employed, it is most preferable that a Zener diode is connected to the conductive film for maintaining the conductive film at a predetermined potential. For instance, when a Zener diode for maintaining a potential of 500 V is connected to the conductive film, it can prevent the potential of the conductive film from increasing excessively high, so that destruction or disturbance of the latent electrostatic image due to a spark discharge can be obviated and the image density can be controlled. Also, by varying the potential of the Zener diode, the thickness of line image can be controlled as desired, so that this arrangement has an advantage that the appearance of the image can be controlled as desired.

Figure 4:
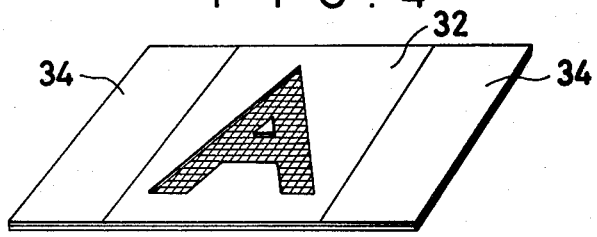

It is not always necessary to make the conductive film wholly conductive, but as shown in FIG. 4, by forming an electrically conductive portion 34, for instance, by aluminium evaporation of part of the unperforated portion of the plastic film 32, the same effect can be attained. Alternatively, the conductive portion 34 can be segmented so as to form segmented electrodes. By this arrangement, a bias potential suitable for the potential distribution of the first electrostatic latent image can be induced or applied to this electrically conductive portion.

In the above-mentioned embodiment, the perforated film for forming the second latent electrostatic image is shaped in a reel form, but this can be made in a fish form and it can be successively fed between the photoconductive drum 1 and the second charging apparatus 3 by use of a known fish or card selection apparatus with a holder of the film.

In the latent electrostatic image formation method employing such perforated films, as the latent image supporting member, not only a photoconductor but also an ordinary dielectrics can be employed.

Furthermore, the latent electrostatic image can be formed on the latent electrostatic image supporting member without bringing the perforated film into close contact with the latent electrostatic image supporting member. When a latent electrostatic image is formed with the perforated film out of contact with the latent electrostatic image supporting member, the potential of the latent electrostatic image becomes higher than that of a latent electrostatic image which is formed with the perforated film in contact with the latent electrostatic image supporting member.

This is because the perforated film works just like a grid electrode of a scorotron charger, and by placing the perforated film out of contact with the latent electrostatic image supporting member, the potential of the perforated film increases, whereby the potential of the latent electrostatic image is increased. A latent electrostatic image with not more than 1000 V of potential can be obtained by setting the gap between the perforated film and the latent electrostatic image supporting member in the range of from 0.5 mm to 2 mm and by use of a 6 kV corona charger.

In the latent electrostatic image formation method employing the perforated film, when the dots or meshes of the perforated film are made precisely, the image resolution can be increased up to 6 or 7 lines/mm. According to the present technique in this field, 80 μm diameter dots or the meshes equal to the dots can be made. Therefore, it is sufficiently possible to attain the resolution of 6 or 7 lines/mm.

The multi-image formation method in which the first latent electrostatic image is formed by illumination and the second latent electrostatic image is formed by direct charging can be used in the following manners.

1. Changing the size or shape of the latent image of each letter

For example, letters in the address of a letter are enlarged in comparison with other letters. Furthermore, the first latent electrostatic image is formed by use of a size variation optical system, for example, a reduced latent electrostatic image of an A-4 size drawing is formed and a necessary item is added to the first latent electrostatic image of the necessary item, whereby the whole size of the copy can be reduced to B-5 size.

2. After the exposure means for forming a first latent electrostatic image, there is disposed a light illumination apparatus with a time control device, whereby an unnecessary portion of the first latent electrostatic image is erased. For example, in the case where an original is a letter and a number of the same letters are copied with the address of each letter changed, the address portion formed by the first latent electrostatic image is erased by light illumination and on the erased portion, a latent electrostatic image of a different address is formed by the second latent electrostatic image formation.

3. By differing the potential of the first latent electrostatic image from that of the second latent electrostatic image, the image density can be varied from place to place in one copy. For instance, when ruled lines are added to a copy by the second latent electrostatic image, the ruled lines can be made faint. The potential of the latent electrostatic image can be changed by changing the potential applied by the corona charger or by use of a scorotron charger.

As mentioned above, the potential of the latent electrostatic image can be changed by the gap between the perforated film and the latent electrostatic image supporting member.

By developing the first and the second latent electrostatic image by a bias development, with the potential of the first latent electrostatic image and that of the second latent electrostatic image made different, a two-color development can be made.

4. By changing the polarity of the first latent electrostatic image and that of the second latent electrostatic image, the two-color development can be made, in which two different colored toners charged in different polarities are caused to deposit on the latent electrostatic images with different polarities, respectively. In this case, two development apparatuses are provided or the two different colored toners are mixed in one development apparatus.

By combining this method with the method of making the potential of the first latent electrostatic image and that of the second latent electrostatic image different, development with more than two colors can be made.

Figure 5:
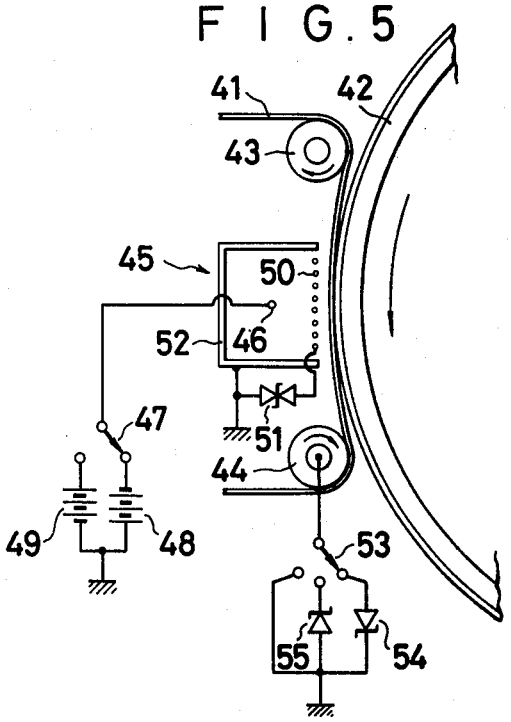
FIG. 5 is a schematic sectional side view of a second corona charger that can be employed in the apparatus shown in FIG. 1.

Referring to FIG. 5, there is shown a second latent electrostatic image formation apparatus with a polarity reversing apparatus for making a two-color development employing a perforated film 41. The perforated film 41 has an electrically conductive layer on its back side and is guided by a pair of electrically conductive rollers 43 and 44 which are disposed movably in the direction of a photoconductor drum 42 during the latent electrostatic image formation in such a manner that the perforated film 41 is moved at the same speed as that of the photoconductive drum 42 which is rotated in the direction of the arrow and that the front side of the perforated film 41 is in contact with the surface of the photoconductor drum. A scorotron charger 45 is disposed so as to face a portion of the perforated film 41 which is in contact with the photoconductor drum 42. To a corona electrode 46 of the scorotron charger 45 are connected, through a switch 47, to two direct current power sources 48 and 49 with their polarities reversed. To a grid electrode 50 is connected one terminal of a varistor 51 for making the potential of corona charge uniform. The other terminal of the varistor 51 and a shield case 52 are grounded. The conductive roller 44 is grounded through a switch 53 while a latent electrostatic image is not formed, and when a latent electrostatic image is formed, the conductive roller 44 is connected to a Zener diode 54 or a Zener diode 55, each of which is reversed in its connecting polarity. These diodes are mainly used for the control of the potential of the film 41 and the control of image quality by preventing the spark discharge when the perforated film 41 is separated from the surface of the photoconductive drum 42.

On the surface of the photoconductor drum 42, there is formed a first latent electrostatic image in advance, and in the case where the polarity of the latent electrostatic image is positive, a negative voltage is applied to the scorotron charger 45 by a switch 47 from a power source 48 when a second latent electrostatic image is formed by the perforated film 41, and the electrically conductive roller 44 is connected to the Zener diode 54 through the switch 53. When the polarity of the first latent electrostatic image is negative, a positive voltage is applied to the scorotron charger 45 from a power source 48 and the electrically conductive roller 44 is connected to the Zener diode 55.

In this method, since latent electrostatic images with different polarities are formed on the photoconductor, the photoconductor has to be capable of forming such latent electrostatic images thereon. In the case of the ordinary selenium-base photoconductor and zinc oxide base photoconductor, the characteristics of their semiconductivity are different, depending upon the polarity of a latent electrostatic image to be formed thereon. Therefore, they can be employed by applying a special treatment thereto so as to reduce their polarity dependence. Alternatively, they can be used with a dielectrics and coated thereon by charging and exposing them in a reverse electric field method. Some organic photoconductors can be charged in both polarities.

Development can be made by either a wet type toner or a dry type toner. A toner for developing a first latent electrostatic image is charged to a polarity opposite to that of the first latent electrostatic image, and a toner for developing a second latent electrostatic image is also charged to a polarity opposite to that of the second latent electrostatic image. Since the polarity of the first latent electrostatic image is opposite to that of the second latent electrostatic image, the respective polarities of the two toners are opposite to each other. Therefore, when the two toners are stirred in an identical container so as to be charged to opposite polarities, toner charging means is unnecessary. The description of the present invention so far made relates to a method in which the first latent electrostatic image is formed by exposure and the second latent electrostatic image is formed by direct charging employing a corona charger and a perforated film.

Figure 6:
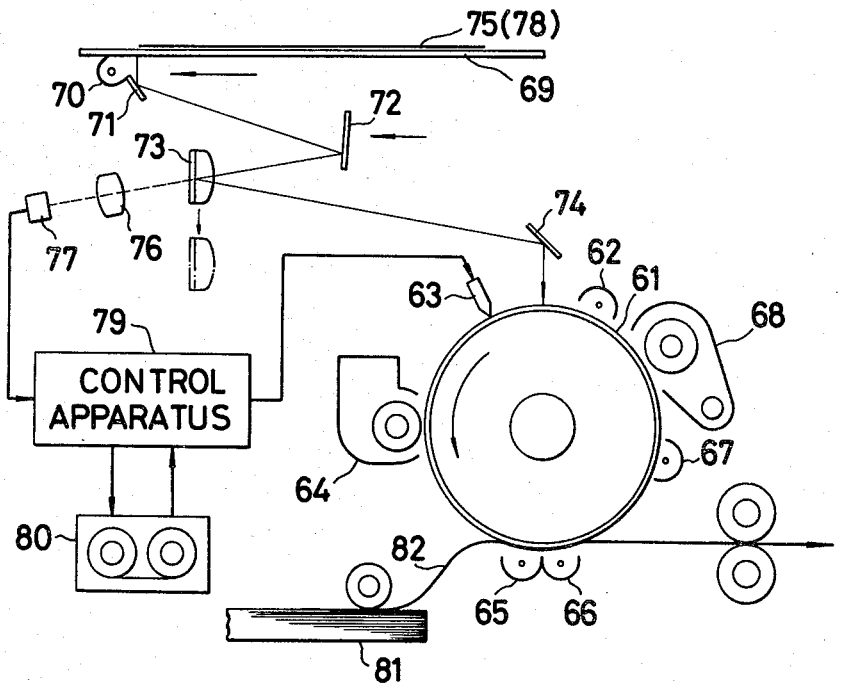
FIG. 6 is a schematic sectional side view of another electrophotographic copying apparatus employing a multi-image formation method according to the present invention.

Referring to FIG. 6, there is schematically shown another example of an electrophotographic copying apparatus employing a multi-image formation method according to the present invention, wherein the second latent electrostatic image is formed by direct charging employing a multi-stylus electrode. In FIG. 6, a photoconductive drum 61 is rotated counterclockwise at a predetermined speed. Around the photoconductive drum 61, there are arranged a corona charger 62, a multi-stylus electrode 63, a development apparatus 64, an image transfer corona charger 65, a sheet separation corona charger 66, a quenching corona charger 67 and a cleaning apparatus 68, which are disposed in the rotating direction of the photoconductive drum 61.

The surface of the photoconductive drum 61 is uniformly charged by the corona charger 62, and on the photoconductive drum 61, a light image of an original is projected by an exposure apparatus, whereby a first latent electrostatic image is formed on the surface of the photoconductive drum 61.

The exposure apparatus comprises a contact glass 69 for placing an original document thereon, an exposure lamp 70, a first reflector 71, a second reflector 72, an in-mirror lens 73 and a third reflector 74.

At the time of exposure, an original document 75 having a positive image is placed face-down on the contact glass 69, and the exposure lamp 70 and the first reflector 71 are moved integrally at a speed V in the direction of the arrow, while the second reflector 72 is also moved in the same direction at a speed $\frac{1}{2}$V.

Furthermore, behind the in-mirror lens 73 which is disposed in the path of the reflected light of the second reflector 72, there are disposed a through-lens 76 and a line image sensor 77 having a charge coupled device, which constitute an optical system for forming a second latent electrostatic image. When this optical system is operated, the in-mirror lens 73 for the formation of the first latent electrostatic image is retracted from the above-mentioned reflected light path of the second reflector 72.

The second latent electrostatic image is formed as follows. First, an original document 78 for the formation of the second latent electrostatic image is placed face-down on the contact glass 69. By the movement of the lamp 70, the first reflector 71 and the second reflector 72, the original document 78 is sub-scanned. At the same time, the main scanning of the original document 78 is made by the line image sensor 77. The optical information read by the line image sensor 77 is converted into an electric signal, which is processed by a control apparatus 79 and is then stored temporarily in a magnetic tape apparatus 80 as an image signal. When an instruction for forming the second latent electrostatic image is given to the magnetic tape apparatus 80, the image signal which has been stored in the magnetic tape apparatus 80 is processed in the control apparatus 79 and is then applied to the multi-stylus electrode 63. The optical information read by the line image sensor 77 is reproducingly recorded on the surface of the photoconductive drum 61 in the form of a latent electrostatic image by the multi-stylus electrode 63.

When the first latent electrostatic image and the second electrostatic image are formed on the photoconductive drum 61, they are developed by the development apparatus 64. On the thus developed toner images on the photoconductive drum 61 is superimposed a transfer sheet 82 which is fed from a transfer sheet feeding tray 81, and by the image transfer corona charger 65, the toner images are transferred to the transfer sheet 82. The transfer sheet 82 is separated from the surface of the photoconductive drum 61 by the sheet separation corona charger 66 whose charging polarity is opposite to that of the image transfer corona charger 65. The thus separated transfer sheet 82 is transported in a predetermined direction and the toner image is then fixed to the transfer sheet 82. After the image transfer, the surface charge of the photoconductive drum 61 is quenched and the photoconductive drum 61 is cleaned by the cleaning apparatus.

Figure 7:
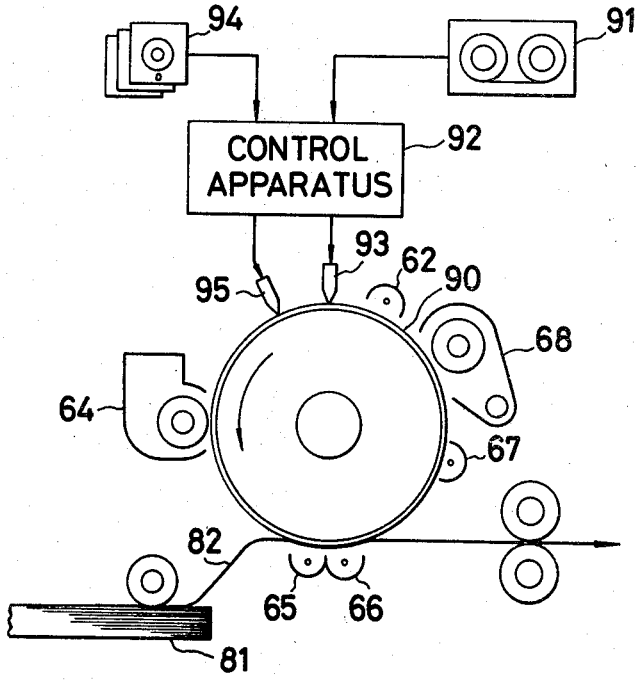
FIG. 7 is a schematic sectional side view of an electrostatic recording apparatus employing a multi-image formation method according to the present invention.

Referring to FIG. 7, there is schematically shown an example of multi-image formation apparatus according to the present invention, wherein both a first latent electrostatic image and a second latent electrostatic image are formed by direct charging employing two multi-stylus electrodes. This apparatus has the following advantages over the previously mentioned image formation apparatuses in which the first latent electrostatic image is formed by exposure and the second latent electrostatic image is formed by direct charging.

1. Ordinary dielectrics can be employed as a latent electrostatic image supporting member. In the formation of a latent electrostatic image by exposure, a photoconductor has to be employed. However, photoconductors are generally expensive and apt to be scratched. Therefore, it is advantageous that ordinary dielectrics can be employed as the latent electrostatic image supporting member, although photoconductors can be employed as well in principle. In a recording method by forming a latent electrostatic image, since the recording speed depends upon the charging speed, a high speed recording can be attained by dielectrics.

2. A partial erasing and addition of a latent electrostatic image can be easily made in the case of dielectrics. In the case where a first latent electrostatic image has already been formed, it is possible to erase part of the first latent electrostatic image and another latent electrostatic image can be formed in place of the erased portion of the first latent electrostatic image. A second latent electrostatic image is formed with an unnecessary portion thereof eliminated. This can be attained by controlling the voltage applied to the stylus electrodes.

3. An input signal to be applied to the multi-stylus electrodes can be fed from a computer system. Therefore, information stored in a recording medium, such as perforator slip, card, magnetic tape and the like can be directly used so that information can be handled systematically.

In the apparatus schematically shown in FIG. 7, the first and the second latent electrostatic image are formed by direct charging employing such multi-stylus electrodes. Therefore, as the latent electrostatic image supporting member, a dielectrics drum 90 can be employed. The dielectrics drum 90 consists essentially of an electrically conductive drum and a dielectrics layer which is formed on the electrically conductive drum.

In the formation of a first latent electrostatic image, the information stored in a magnetic tape apparatus is processed by a control apparatus and is applied to a multi-sylus electrode 93 in the form of a video signal, whereby a first latent image is formed on the dielectrics drum 90. As for a second latent electrostatic image, the information stored in a floppy disk 94 is likewise processed by the control apparatus 92 and the processed information is applied to the other multi-stylus electrode 95. The succeeding processes are the same as those in the apparatus shown in FIG. 6. Thus, the apparatuses or members in FIG. 7 which are identical with those in FIG. 6 are given the same reference numerals as those in FIG. 6, and the explanation of the apparatuses or members is omitted here. Also in such multi-image formation method in which both the first and the second latent electrostatic image are formed by direct charging, the size and image density of letters or images can be changed and two-color development can be made as in the previously mentioned apparatus.

Furthermore, by disposing a desired number of latent image formation means, various pieces of information can be synthesized.

In general, image information to be reproduced can be classified into a visible information and an invisible information. The visible information signifies an information whose contents are visible as in documents, photographs, films and the like, and the invisible information signifies an information whose contents cannot be directly seen as in the information stored in magnetic tapes, perforator cards or tape and the like.

Therefore, when the two types of image information are synthesized, there may be three cases. The first case is that two types of image information are both visible, and the second case is that one information is visible while the other information is invisible, and the third case is that two types of information are both invisible.

Furthermore, image information to be reproduced can be classified into a fixed information and a variable information from the point of view of the contents of the image information. The fixed information signifies an information which cannot be changed as in a format, and the variable information signifies an information which may be changed as in data. Therefore, there are three cases in synthesizing two types of information. The first case is that both are fixed information, and the second case is that one information is fixed information, while the other information is variable information, and the third case is that both are variable information.

In synthesizing two pieces of information and reproducing them, construction of a copying apparatus for handling such different information differs depending upon whether the original information is visible or invisible, or fixed or variable.

In the image formation apparatus shown in FIG. 1, since the first latent electrostatic image is formed by projecting a light image upon the photoconductor, the original information for forming the first latent electrostatic image has to be visible, and also the original information for forming the second latent electrostatic image has to be visible since a perforated film is employed. However, as to the contents of the original information, any information can be either visible or fixed.

In the image formation apparatus shown in FIG. 6, since the first latent electrostatic image is formed by projecting a light image upon the photoconductor, the original information has to be visible, and can be either fixed or variable. On the other hand, the second latent electrostatic image can be formed by an input signal from the magnetic tape apparatus. Therefore, it can be said that the original information is invisible. However, since visible information read by the line sensor is stored in the magnetic tape, the first original information has to be visible. In the case where information of a computer output is stored in the magnetic tape, the original information is invisible.

In the image formation apparatus shown in FIG. 7, the original information for the first latent elecstatic image and that for the second latent electrostatic image are both invisible since they come from a magnetic tape or a floppy disk. Since the capacity of the magnetic tape is so great that it is suitable for storing variable information, such as data, while the floppy disk is suitable for storing fixed information as in a format. However, it is not always necessary that the original information for the first latent electrostatic image be variable information and that that for the second latent electrostatic image be fixed information. Of course, the opposite combination can be acceptable. For instance, such apparatus can be used in preparing a stock price list of stocks. Names are stored in a computer as fixed information, while starting price, high price, low price, final price and comparative price of stocks are stored in the computer as variable information, whereby a stock price list can be prepared everyday.

What is claimed is:

1. An electrostatic apparatus for copying synthesized recorded information from at least two information sources onto a copy sheet comprising a photoconductive member adapted to receive a latent electrostatic image, a first charging means for charging said photoconductive member, a light source, and optical means for transmitting a light image of a first source of information onto said photoconductive member to form a first latent electrostatic image corresponding to the transmitted light image of said first source on said photoconductive member, second charging means for directly charging said photoconductive member to form a second latent electrostatic image of a second source of information on said photoconductive member whereby said second latent electrostatic image is formed on said photoconductive member while retaining said first latent electrostatic image, said second source of information including a dielectric ion permeable film disposed between said second source of information and said second charging means whereby actuation of said second charging means permits corona ions to pass through said film so as to form said second latent image of said second source of information on said photoconductive member, and means for developing said latent electrostatic images.

2. An electrostatic apparatus as defined in claim 1, wherein said film has minute perforations therein to define said second source of recorded information whereby said second latent electrostatic image is formed by the corona ions passing through said perforations.

3. An electrostatic apparatus as defined in claim 2 wherein said film comprises a dielectric substrate having perforations therein and sheet material superposed on said perforated substrate, said sheet material having cut-out portions to define said second source of recorded information.

4. An electrostatic apparatus as defined in claim 3 and including means for rendering said sheet material electrically conductive.

5. An electrostatic apparatus as defined in claim 4 wherein said sheet material includes a thermal shrinking plastic.

6. An electrostatic apparatus as defined in claim 3 wherein said sheet material is a metallic foil.

* * * * *